US011404207B2

(12) United States Patent
Tsubokura et al.

(10) Patent No.: US 11,404,207 B2
(45) Date of Patent: Aug. 2, 2022

(54) METHOD FOR MANUFACTURING R-T-B PERMANENT MAGNET

(71) Applicant: TDK Corporation, Tokyo (JP)

(72) Inventors: Taeko Tsubokura, Tokyo (JP); Takeshi Masuda, Tokyo (JP); Taku Murase, Tokyo (JP)

(73) Assignee: TDK Corporation, Tokyo (JP)

( * ) Notice: Subject to any disclaimer, the term of this patent is extended or adjusted under 35 U.S.C. 154(b) by 153 days.

(21) Appl. No.: 16/698,083

(22) Filed: Nov. 27, 2019

(65) Prior Publication Data

US 2020/0176184 A1 Jun. 4, 2020

(30) Foreign Application Priority Data

Dec. 3, 2018 (JP) ..... JP2018-226664

(51) Int. Cl.

| | |
|---|---|
| ***H01F 41/02*** | (2006.01) |
| ***H01F 1/057*** | (2006.01) |
| ***C22C 38/00*** | (2006.01) |
| ***C22C 28/00*** | (2006.01) |
| ***C22C 30/02*** | (2006.01) |
| ***C23C 10/30*** | (2006.01) |

(52) U.S. Cl.

CPC ..... *H01F 41/0293* (2013.01); *C22C 28/00* (2013.01); *C22C 30/02* (2013.01); *C23C 10/30* (2013.01); *H01F 1/057* (2013.01); *H01F 41/0266* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2018/0218835 | A1* | 8/2018 | Jang | H01F 1/0577 |
| 2018/0286545 | A1* | 10/2018 | Fujikawa | H01F 1/0577 |
| 2019/0214192 | A1 | 7/2019 | Kuniyoshi et al. | |
| 2020/0161047 | A1 | 5/2020 | Zhou et al. | |
| 2020/0303120 | A1 | 9/2020 | Zhou et al. | |
| 2020/0395153 | A1* | 12/2020 | Kim | H01F 41/0266 |

FOREIGN PATENT DOCUMENTS

| | | | |
|---|---|---|---|
| CN | 107146670 | A | 9/2017 |
| CN | 108183021 | A | 6/2018 |
| WO | WO-2018/030187 | A1 | 2/2018 |

* cited by examiner

*Primary Examiner* — Xiaowei Su

(74) *Attorney, Agent, or Firm* — Faegre Drinker Biddle & Reath LLP

(57) ABSTRACT

A method for manufacturing an R-T-B permanent magnet comprises a diffusion step of adhering a diffusing material to the surface of a magnet base material and heating the magnet base material with the diffusing material adhered thereto, wherein the magnet base material comprises rare-earth elements R, transition metal elements T and boron B; at least some of R are Nd; at least some of T are Fe; the diffusing material comprises a first component, a second component and a third component; the first component is at least one of a simple substance of Tb and a simple substance of Dy; the second component comprises a metal comprising at least one of Nd and Pr and not comprising Tb and Dy; and the third component is at least one selected from the group consisting of a simple substance of Cu, an alloy comprising Cu, and a compound of Cu.

4 Claims, 2 Drawing Sheets

METHOD FOR MANUFACTURING R-T-B PERMANENT MAGNET

TECHNICAL FIELD

The present invention relates to a method for manufacturing an R-T-B permanent magnet.

BACKGROUND

An R-T-B permanent magnet containing rare-earth elements R (neodymium or the like), transition metal elements T (iron or the like) and boron B has excellent magnetic properties. As indices of magnetic properties of an R-T-B permanent magnet, residual magnetic flux density Br (residual magnetization) and coercivity HcJ are generally used.

An R-T-B permanent magnet is a nucleation type permanent magnet. Application of a magnetic field in the direction opposite to magnetization direction to a nucleation type permanent magnet allows magnetization reversal nuclei to easily occur in the vicinity of grain boundaries of many crystal grains (main phase grains) of the permanent magnet. The coercivity of a permanent magnet is reduced by the magnetization reversal nuclei.

In order to improve the coercivity of an R-T-B permanent magnet, heavy rare-earth elements such as dysprosium is added to the R-T-B permanent magnet. Addition of heavy rare-earth elements allows an anisotropic magnetic field to easily grow larger locally in the vicinity of grain boundaries, so that magnetization reversal nuclei hardly occur in the vicinity of grain boundaries, resulting in increase of coercivity. In the case where the amount of heavy rare-earth elements added is too much, however, the saturation magnetization (saturation magnetic flux density) of the R-T-B permanent magnet decreases, and the residual magnetic flux density also decreases. It is therefore desirable to balance between the residual magnetic flux density and the coercivity of a heavy rare-earth element-containing R-T-B permanent magnet. Since the cost of heavy rare-earth elements is high, it is also desirable that the content of the heavy rare-earth elements in an R-T-B permanent magnet is reduced in order to reduce the production cost of the R-T-B permanent magnet.

For example, a method for manufacturing an R-T-B sintered magnet described in International Publication No. WO 2018/030187 comprises a step of adhering a diffusing material in powder form to the surface of a sintered magnet through an adhesive, and a step of diffusing a heavy rare-earth element in the diffusing material into the sintered magnet by heating the sintered magnet with the diffusing material adhered thereto. In International Publication No. WO 2018/030187, an alloy containing at least one heavy rare-earth element of dysprosium and terbium and at least one light rare-earth element of neodymium and praseodymium is described as one example of the diffusing material.

SUMMARY

The present invention has been completed in light of the above-mentioned circumstances, and an object thereof is to provide a method for manufacturing an R-T-B permanent magnet excellent in magnetic properties.

A method for manufacturing an R-T-B permanent magnet in an aspect of the present invention comprises a diffusion step of adhering a diffusing material to the surface of a magnet base material and heating the magnet base material with the diffusing material adhered thereto, wherein the magnet base material comprises rare-earth elements R, transition metal elements T and boron B; at least some of rare-earth elements R are neodymium; at least some of transition metal elements T are iron; the diffusing material comprises a first component, a second component and a third component; the first component is at least one of a simple substance of terbium and a simple substance of dysprosium; the second component is a metal comprising at least one of neodymium and praseodymium and not comprising terbium and dysprosium; and the third component is at least one selected from the group consisting of a simple substance of copper, an alloy comprising copper, and a compound of copper.

In an aspect of the present invention, the second component may be at least one of a simple substance of neodymium and a simple substance of praseodymium, and the third component may be a simple substance of copper.

A method for manufacturing an R-T-B permanent magnet in another aspect of the present invention comprises a diffusion step of adhering a diffusing material to the surface of a magnet base material and heating the magnet base material with the diffusing material adhered thereto, wherein the magnet base material comprises rare-earth elements R, transition metal elements T and boron B; at least some of rare-earth elements R are neodymium; at least some of transition metal elements T are iron; the diffusing material comprises a first component, a second component and a third component; the first component is at least one of a hydride of terbium and a hydride of dysprosium; the second component is at least one of a hydride of neodymium and a hydride of praseodymium; and the third component is at least one selected from the group consisting of a simple substance of copper, an alloy comprising copper, and a compound of copper.

The diffusing material may be a slurry or a paste.

The total mass of terbium, dysprosium, neodymium, praseodymium and copper in the diffusing material may be expressed as $M_{ELEMENTS}$; the total mass of terbium and dysprosium in the diffusing material relative to $M_{ELEMENTS}$ may be 55% by mass or more and 85% by mass or less; the total mass of neodymium and praseodymium in the diffusing material relative to $M_{ELEMENTS}$ may be 10% by mass or more and 37% by mass or less; and the total mass of copper in the diffusing material relative to $M_{ELEMENTS}$ may be 4% by mass or more and 30% by mass or less.

According to the present invention, a method for manufacturing an R-T-B permanent magnet excellent in magnet properties is provided.

DETAILED DESCRIPTION

Figure 1A:
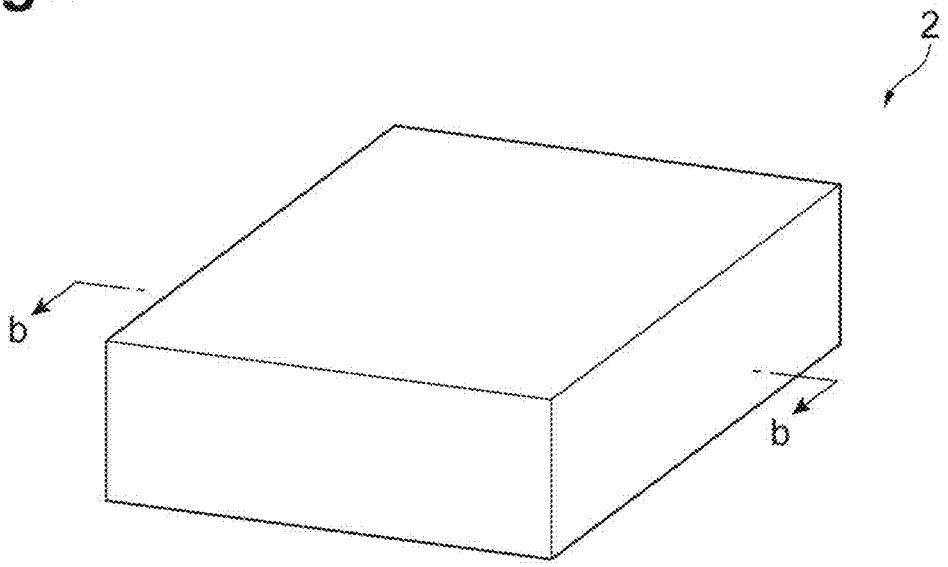
FIG. 1A is a schematic perspective view of a magnet base material.

Suitable embodiments of the present invention will be described hereinafter with reference to drawings. In the drawings, the same symbols are given to the same or corresponding elements. The present invention is not limited to the following embodiments. A "permanent magnet" described in the following means an R-T-B permanent magnet.

(Method for Manufacturing Permanent Magnet)

A method for manufacturing a permanent magnet in a first embodiment comprises a diffusion step of adhering a diffusing material to the surface of a magnet base material and heating the magnet base material with the diffusing material adhered thereto. The magnet base material comprises rare-earth elements R, transition metal elements T and boron B. At least some of rare-earth elements R are neodymium. At least some of transition metal elements T are iron. The diffusing material comprises a first component, a second component and a third component. The first component is at least one of a simple substance of terbium and a simple substance of dysprosium. The second component is a metal comprising at least one of neodymium and praseodymium and not comprising terbium and dysprosium. The metal implicates a simple substance and an alloy. The third component is at least one selected from the group consisting of a simple substance of copper, an alloy comprising copper, and a compound of copper.

A method for manufacturing a permanent magnet in a second embodiment is the same as the method for manufacturing a permanent magnet in the first embodiment, except for the first component and the second component for use in the diffusion step. The first component in the second embodiment is at least one of a hydride of terbium and a hydride of dysprosium. The second component in the second embodiment is at least one of a hydride of neodymium and a hydride of praseodymium.

In the following, the first embodiment and the second embodiment are described in parallel. In the following, details of each step of the method for manufacturing a permanent magnet are described.

[Preparation Step of Raw Material Alloy]

In the preparation step of a raw material alloy, the raw material alloy may be made from metals (raw material metals) containing each of the elements to compose the permanent magnet by strip casting or the like. The raw material metal may be, for example, a simple substance of rare-earth element (simple substance of metal); an alloy containing a rare-earth element; pure iron; ferroboron or an alloy containing these. These raw material metals are weighed corresponding to the composition of a desired magnet base material. As the raw material alloy, two or more types of alloys having a different composition may be prepared.

The raw material alloy comprises at least rare-earth elements R, transition metal elements T and boron B.

At least some of R in the raw material alloy are neodymium (Nd). The permanent magnet may further comprise at least one selected from the group consisting of scandium (Sc), yttrium (Y), lanthanum (La), cerium (Ce), praseodymium (Pr), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu) as another R. The raw material alloy may comprise Pr. The raw material alloy may not comprise Pr. The raw material alloy may comprise one or both of Tb and Dy. The raw material alloy may not comprise one or both of Tb and Dy.

At least some of the transition metal elements T in the raw material alloy are iron (Fe). T may be Fe and cobalt (Co). All of T may be Fe. All of T may be Fe and Co. The raw material alloy may further comprise transition metal elements other than Fe and Co. The following T described below means Fe alone, or Fe and Co.

The raw material alloy may further comprise other elements in addition to R, T and B. For example, the raw material alloy may comprise at least one selected from the group consisting of copper (Cu), gallium (Ga), aluminum (Al), zirconium (Zr), manganese (Mn), carbon (C), nitrogen (N), oxygen (O), calcium (Ca), nickel (Ni), silicon (Si), chlorine (Cl), sulfur (S) and fluorine (F) as other elements. The raw material alloy may comprise Cu. The raw material alloy may not comprise Cu.

[Pulverization Step]

In the pulverization step, the raw material alloy described above may be pulverized in non-oxidizing atmosphere to prepare an alloy powder. The raw material alloy may be pulverized in two steps including a coarse pulverization step and a fine pulverization step. In the coarse pulverization step, a pulverizing method using, for example, a stamp mill, a jaw crusher or a Brown mill, may be used. The coarse pulverization step may be performed in an inert gas atmosphere. After hydrogen is stored into a raw material alloy, the raw material alloy may be pulverized. In other words, hydrogen storage pulverization may be performed as the coarse pulverization step. In the coarse pulverization step, the raw material alloy may be pulverized into a particle size of about several hundred μm. In a fine pulverization step subsequent to the coarse pulverization step, the raw material alloy after going through the coarse pulverization step may be further pulverized into an average particle size of several μm. In the fine pulverization step, for example, a jet mill may be used. The raw material alloy may be pulverized in one pulverization step alone. For example, a fine pulverization step only may be performed. In the case where a plurality of raw material alloys are used, each of the raw material alloys may be separately pulverized and then mixed. The alloy powder may comprise at least one lubricant (pulverizing aid) selected from the group consisting of a fatty acid, a fatty acid ester and a metal salt of fatty acid (metal soap). In other words, the raw material alloy may be pulverized together with a pulverizing aid.

[Molding Step]

In a molding step, an alloy powder is molded in a magnetic field, so that a green compact comprising the alloy powder oriented along the magnetic field may be obtained. For example, while applying a magnetic field to the alloy powder in a mold, the alloy powder is pressurized in the mold, so that a green compact may be obtained. The pressure applied to the alloy powder in the mold may be 20 MPa or more and 300 MPa or less. The strength of the magnetic field applied to the alloy powder may be 950 kA/m or more and 1600 kA/m or less.

[Sintering Step]

In a sintering step, the green compact is sintered in vacuum or in an inert gas atmosphere, so that a sintered body may be obtained. Sintering conditions may be appropriately set depending on the composition of a target permanent magnet, the pulverizing method and the particle size of raw material alloy, etc. The sintering temperature may be, for example, 1000° C. or more and 1200° C. or less. The sintering time may be 1 hour or more and 20 hours or less.

[Aging Step]

In an aging step, the sintered body may be heated at a temperature lower than the sintering temperature. In an aging step, the sintered body may be heated in vacuum or in an inert gas atmosphere. A diffusion step described below may be combined with the aging step. In that case, an aging step separate from the diffusion step may not be performed. The aging step may comprise a first aging step and a second aging step subsequent to the first aging step. In the first aging step, a sintered body may be heated at 700° C. or more and 900° C. or less. The time for the first aging may be 1 hour or more and 10 hours or less. In the second aging step, a sintered body may be heated at 500° C. or more and 700° C. or less. The time for the second aging may be 1 hour or more and 10 hours or less.

Figure 1B:
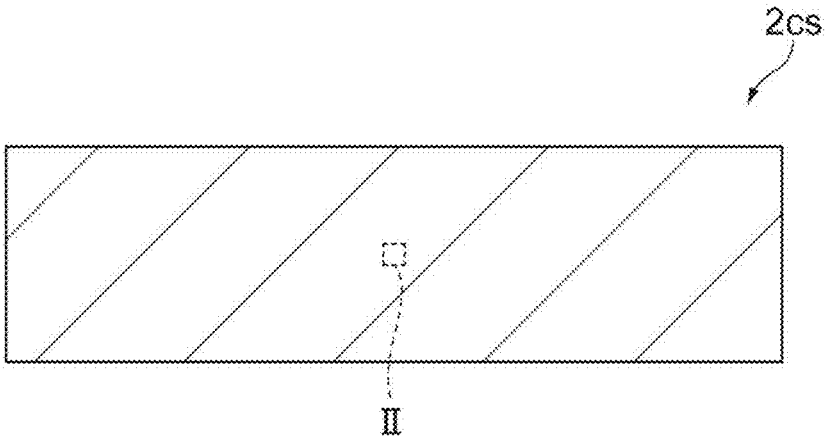
FIG. 1B is a schematic cross-sectional view of the magnet base material shown in FIG. 1A (viewed from the arrow direction of b-b line).
Figure 2:
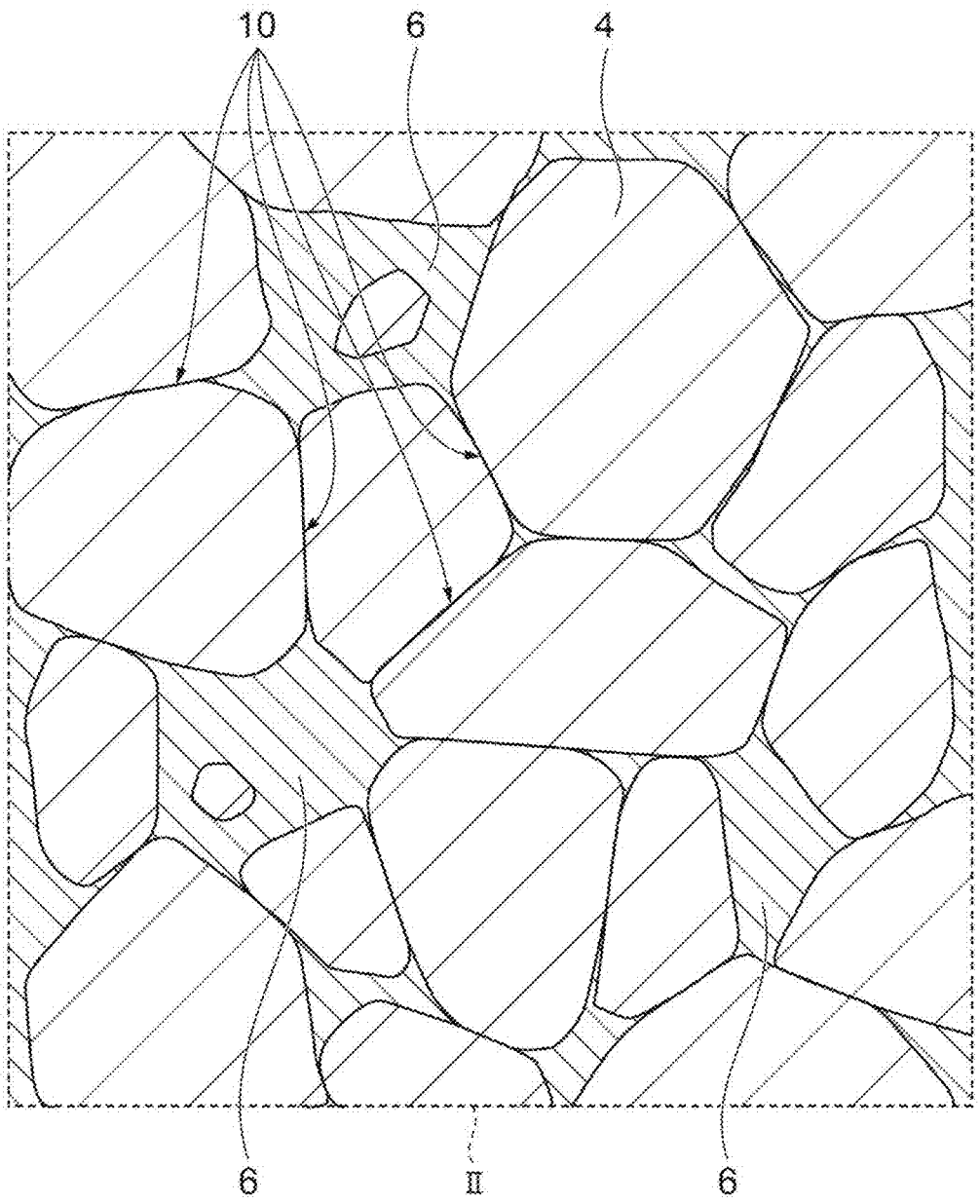
FIG. 2 is an enlarged view of a portion (region II) of the cross-section of the magnet base material shown in FIG. 1B.

After the steps described above, a sintered body is obtained. The sintered body is a magnet base material for use in the following diffusion step. FIG. 1A is a schematic perspective view of a magnet base material 2. As shown in FIG. 1A, the magnet base material 2 may be in a rectangular parallelepiped shape. The shape of the magnet base material 2, however, is not limited. FIG. 1B is a schematic view of a cross-section 2*cs* of the magnet base material 2. FIG. 2 is an enlarged view of a portion of the cross-section 2*cs* of the magnet base material 2 (region II). As shown in FIG. 2, the magnet base material 2 (sintered body) comprises a plurality of (many) main phase grains 4 sintered to each other. The average composition of the main phase grains 4 included in the magnet base material 2, however, is different from the average composition of the main phase grains included in the completed permanent magnet. The main phase grains 4 comprise at least Nd, Fe and B. The main phase grains 4 may comprise a $R_2T_{14}B$ crystal, wherein at least some of R may be Nd, and at least some of T may be Fe. A part of or the whole of the main phase grains 4 may consist of $R_2T_{14}B$ crystal (single crystal or polycrystal). $R_2T_{14}B$ may be, for example, $Nd_2Fe_{14}B$. Some of Nd in $Nd_2Fe_{14}B$ may be substituted with at least one of Pr, Tb and Dy. Some of Fe in $Nd_2Fe_{14}B$ may be substituted with Co. The main phase grain 4 may comprise the elements described above (elements which may be contained in raw material alloy) in addition to R, T and B. The magnet base material 2 comprises a plurality of grain boundary triple points 6 as well. The grain boundary triple point 6 is a grain boundary phase surrounded by at least three main phase grains 4. The average composition of the grain boundary triple points 6 included in the magnet base material 2, however, is different from the average composition of the grain boundary triple points included in the completed permanent magnet. The magnet base material 2 comprises a plurality of two-grain boundaries 10 as well. The two-grain boundary 10 is a grain boundary phase located between two neighboring main phase grains 4. The average composition of the two-grain boundaries 10 included in the magnet base material 2, however, is different from the average composition of the two-grain boundaries 10 included in the completed permanent magnet. The grain boundary phase may comprise at least Nd, and the Nd content in the grain boundary phase may be larger than the Nd content in the main phase grain 4. In other words, the grain boundary phase may be a Nd-rich phase. The grain boundary phase may comprise at least one of Fe and B in addition to Nd.

The average grain size of the main phase grains 4 is not particularly limited, and may be, for example, 1.0 μm or more and 10.0 μm or less. The total volume ratio of the main phase grains 4 in the magnet base material 2 is not particularly limited, and may be, for example, 75% by volume or more and less than 100% by volume.

[Diffusion Step]

In a diffusion step, a diffusing material is adhered to the surface of the magnet base material, and the magnet base material with the diffusing material adhered thereto is heated. The diffusing material comprises a first component, a second component and a third component described below. The diffusing material may further comprise another component in addition to the first component, the second component and the third component. For the convenience of the following explanation, one or both of Tb and Dy are expressed as RH. One or both of Nd and Pr are expressed as RL.

The first component in the first embodiment is at least one of a simple substance of Tb and a simple substance of Dy. As long as no alloy is formed from RH and RL, the first component may contain an extremely small amount of RL. In other words, the first component may contain RL and other elements as unavoidable impurities. The alloy is at least any one of a solid solution, a eutectic and an intermetallic compound.

In the case where the first component is at least any one of the simple substance of Tb and the simple substance of Dy, the first component is able to be easily made only by pulverization of the simple substance of metal. In other words, in the case where the first component is at least any one of the simple substance of Tb and the simple substance of Dy, a process for making an alloy comprising RH or an alloy comprising RH and RL is unnecessary, and a process for pulverizing an alloy which is harder than the simple substance is also unnecessary. Since making and pulverizing of the alloy is unnecessary, the manufacturing cost of a permanent magnet is reduced.

The second component in the first embodiment is a metal comprising at least one of Nd and Pr and not comprising Tb and Dy. For example, the second component of the first embodiment may be at least one selected from the group consisting of a simple substance of Nd, a simple substance of Pr, and an alloy comprising Nd and Pr. The alloy comprising Nd and Pr may comprise at least one of the elements which may be included in a permanent magnet, excluding Tb and Dy. The second component in the first embodiment may be an alloy consisting of Nd and Pr. As long as no alloy is formed from RH and RL, the second component in the first embodiment may comprise an extremely small amount of RH. In other words, the second component may contain RH and other elements as unavoidable impurities.

In the case where the second component is at least one of the simple substance of Nd and the simple substance of Pr, the second component is able to be easily made only by pulverization of the simple substance of metal. In other words, in the case where the second component is at least any one of the simple substance of Nd and the simple substance of Pr, a process for making an alloy comprising RL or an alloy comprising RH and RL is unnecessary, and a process for pulverizing an alloy which is harder than the simple substance is also unnecessary. Since making and pulverizing of the alloy is unnecessary, the manufacturing cost of a permanent magnet is reduced.

Each of the first component and the second component in the second embodiment is a hydride. In other words, the first component in the second embodiment is at least one of a hydride of Tb and a hydride of Dy. The second component in the second embodiment is at least one of a hydride of Nd and a hydride of Pr. The hydride of Tb may be, for example, at least one of $TbH_2$ and $TbH_3$. The hydride of Tb may be, for example, a hydride of alloy consisting of Tb and Fe. The hydride of Dy may be, for example, at least one of $DyH_2$ and $DyH_3$. The hydride of Dy may be, for example, a hydride of alloy consisting of Dy and Fe. The hydride of Tb and the hydride of Dy may be, for example, a hydride of an alloy consisting of Tb, Dy and Fe. The hydride of Nd may be, for example, at least one of $NdH_2$ and $NdH_3$. The hydride of Pr may be, for example, at least one of $PrH_2$ and $PrH_3$. The hydride of Nd and the hydride of Pr may be a hydride of alloy consisting of Nd and Pr.

In any of the first embodiment and the second embodiment, the third component is at least one selected from the group consisting of a simple substance of Cu, an alloy comprising Cu, and a compound of Cu. The third component may comprise none of Nd, Pr, Tb and Dy. The alloy comprising Cu may comprise at least one element excluding Nd, Pr, Tb and Dy from the elements which may be included in a permanent magnet. The compound of copper may be at least one selected from the group consisting of a hydride and oxide. The hydride of Cu may be, for example, CuH. The oxide of Cu may be at least any one of $Cu_2O$ and CuO.

Each of the first component, the second component and the third component may be powder. As each of the first component, the second component and the third component is in a powder form, RH in the first component, RL in the second component, and Cu in the third component easily diffuse into the internal part of the magnet base material 2. Each of the first component, the second component and the third component may be made through a coarse pulverization step and a fine pulverization step. The methods of the coarse pulverization step and the fine pulverization step are the same as those of the pulverization steps of the raw material alloy described above. The first component, the second component or the third component may be pulverized together at the same time. Through the coarse pulverization step and the fine pulverization step, the particle size of the first component, the second component and the third component each may be freely controlled. For example, after hydrogen is stored into a simple substance of metal, the simple substance of metal may be dehydrogenated. As a result, a coarse powder of metal hydride is obtained. The coarse hydride powder is further pulverized by a jet mill, so that a fine powder of metal hydride is obtained. The fine powder may be used as the first component, the second component or the third component.

As described below, the diffusing material further comprises the second component and the third component in addition to the first component, so that the magnetic properties of the permanent magnet can be improved.

By heating the magnet base material 2 with a diffusing material adhered thereto, RH derived from the first component diffuses into the internal part of the magnet base material 2, RL derived from the second component diffuses into the internal part of the magnet base material 2, and Cu derived from the third component diffuses into the internal part of the magnet base material 2. The present inventors presume that RH, RL and Cu diffuse from the surface of the magnet base material 2 into the internal part of the magnet base material 2 by the following mechanism. The diffusion mechanism, however, is not limited to the following mechanism.

In the case where an alloy comprising RH and RL is used as diffusing material, the alloy adhered to the surface of the magnet base material 2 melts easily and rapidly at the eutectic point of RH and RL. As a result, the alloy in liquid phase stagnates easily on the surface of the magnet base material 2, so that RH in the liquid phase hardly diffuses into the internal part of the magnet base material 2. In other words, a large amount of RH stagnates easily on the surface of the magnet base material 2. RH diffuses into the internal part of the main phase grains 4 located in the vicinity of the surface of the magnet base material 2, so that the magnet properties of the main phase grains 4 located in the vicinity of the surface of the magnet base material 2 are impaired, resulting in reduction in the residual magnetic flux density of a permanent magnet.

In contrast, in the case where the diffusing material comprises the first component (RH), the second component (RL) and the third component (Cu), the melting point of the second component is lower than the melting point of the third component and the melting point of the third component is lower than the melting point of the first component, so that the second component tends to melt faster than the third component and the third component tends to melt faster than the first component. For example, the melting point of Nd is about 1024° C., the melting point of Pr is about 935° C., the melting point of Cu is about 1085° C., the melting point of Tb is about 1356° C., and the melting point of Dy is about 1407° C. RL derived from the second component which melts first diffuses into the internal part of the magnet base material 2 through grain boundaries of the magnet base material 2. In the grain boundaries of the magnet base material 2 (grain boundary triple points 6 and two-grain boundaries 10), RL is present in liquid phase. A part of Nd in the main phase grains 4 originally contained in the magnet base material 2 (one of RL) also seeps into the grain boundaries. In other words, from RL derived from the second component and Nd derived from the main phase grains 4, an ample liquid phase of RL is formed. Since the third component easily melts next to the second component, Cu derived from the third component is able to diffuse into the internal part of the magnet base material 2 at a fast diffusion rate due to interposition of the liquid phase of RL located in the grain boundaries. Cu is easily localized in the grain boundaries where the liquid phase of RL is present (grain boundary triple points 6 and two-grain boundaries 10). The first component tends to melt last, so that RH derived from the first component is substituted with RL in liquid phase located in the vicinity of the surface of the magnet base material 2, and RH diffuses into the internal part of the magnet base material 2. Since Cu diffuses in the grain boundary triple points 6 ahead of RH, RH is hardly trapped in the grain boundary triple points 6. Since Cu located in the two-grain boundaries 10 functions as a path for RH, RH easily diffuses into the two-grain boundaries 10. Due to Cu located in the two-grain boundaries 10, excessive diffusion of RH into the internal part of the main phase grains 4 is suppressed in comparison with the case of absence of Cu. Due to RH undergoing the diffusion process described above, RH is easily localized in the two-grain boundaries 10 and in the vicinity of the surface of the main phase grains 4. In other words, some of Nd located in the two-grain boundaries 10 and in the vicinity of the surface of the main phase grains 4 are easily substituted with RH. As a result, an anisotropic magnetic field grows larger locally in the vicinity of the two-grain boundaries 10 and the magnetization reversal nuclei hardly occur in the vicinity of two-grain boundaries 10, resulting in increase of coercivity of the permanent magnet.

Since the diffusing material comprises the second component (RL) and the third component (Cu) each having a lower melting point than the first component (RH), RH more easily diffuses into the two-grain boundaries 10 at lower temperature in comparison with the case where the diffusing material is made of the first component alone, and RH more easily diffuses into the two-grain boundaries 10 in a shorter time. As a result, in comparison with the case where the diffusing material is made of the first component alone, the temperature and the time required for the diffusion of RH are reduced, so that the excessive diffusion of RH into the internal part (deep part) of the main phase grains 4 is suppressed. Due to the presence of RL derived from the second component as the liquid phase in the grain boundaries (grain boundary triple points 6 and two-grain boundaries 10), in comparison with a diffusing material containing no second component, Nd in the main phase grains 4 does not excessively seep into the grain boundaries, and Nd in the main phase grains 4 is not excessively substituted with RH. For these reasons, the degradation of magnetic properties of each of the main phase grains 4 is suppressed and the reduction in the residual magnetic flux density of a permanent magnet is suppressed.

Since the diffusing material comprises the second component (RL) and the third component (Cu) each having a lower melting point than the first component (RH), RH is able to more certainly diffuse into the two-grain boundaries 10 in comparison with a diffusing material made of the first component (RH) alone. As a result, in comparison with a diffusing material of the first component (RH) alone, the amount of the first component (RH) required for increasing the coercivity of a permanent magnet is reduced, so that the manufacturing cost of a permanent magnet is reduced.

As described above, according to the first embodiment or the second embodiment, the coercivity of the permanent magnet is able to be increased and the RH content in the whole of the permanent magnet is able to be reduced in comparison with a conventional permanent magnet. Due to the reduction in the RH content, the residual magnetic flux density of the permanent magnet hardly decreases. The permanent magnet, therefore, is able to have excellent magnetic properties. In other words, both of the high residual magnetic flux density and the high coercivity of the permanent magnet can be achieved.

As the magnetic properties of the permanent magnet are easily improved by the diffusion mechanism described above, the first component in the first embodiment may be at least one of a simple substance of Tb and a simple substance of Dy, the second component in the first embodiment may be at least one of a simple substance of neodymium and a simple substance of praseodymium, and the third component in the first embodiment may be a simple substance of copper.

As the magnetic properties of the permanent magnet are easily improved by the diffusion mechanism described above, the first component in the second embodiment may be at least one of a hydride of Tb and a hydride of Dy, the second component in the second embodiment may be at least one of a hydride of neodymium and a hydride of praseodymium, and the third component in the second embodiment may be a simple substance of copper.

In the diffusion step, a slurry containing the first component, the second component, the third component and a solvent may be adhered to the surface of the magnet base material 2, as the diffusing material. A slurry is a mixture in liquid state. The solvent in the slurry may be a solvent other than water. The solvent may be an organic solvent such as an alcohol, an aldehyde and a ketone. In order to allow the diffusing material to easily adhere to the surface of the magnet base material 2, the diffusing material may further contain a binder. The slurry may comprise the first component, the second component, the third component, the solvent and the binder. By mixing the first component, the second component, the third component, the binder and the solvent, a paste having a higher viscosity than the slurry may be formed, and the paste may be adhered to the surface of the magnet base material 2. A paste is a mixture having fluidity and high viscosity. Prior to the diffusion step, the magnet base material 2 with a slurry or a paste adhered thereto may be heated to remove the solvent contained in the slurry or the paste.

The diffusing material may be adhered to a part of or the whole of the surface of the magnet base material 2. The adhesion method of the diffusing material is not limited. For example, the slurry or the paste described above may be applied to the surface of the magnet base material 2. The diffusing material itself or the slurry may be sprayed onto the surface of the magnet base material 2. The diffusing material may be vapor-deposited on the surface of the magnet base material 2. The magnet base material 2 may be immersed in the slurry. Through an adhesive (binder) covering the surface of the magnet base material 2, the diffusing material may be adhered to the magnet base material 2. In the diffusion step with use of the slurry or the paste, the amount of the binder used is more easily reduced in comparison with the case where the surface of the magnet base material 2 is covered with an adhesive. In the case of using the slurry or the paste, a binder removal step is therefore not indispensable, and carbon derived from the binder hardly remains in a permanent magnet, so that degradation of magnetic properties of the permanent magnet caused by carbon is easily suppressed.

The temperature of the magnet base material 2 in the diffusion step (diffusion temperature) may be equal to or higher than the melting point or the decomposition temperature of the first component, the second component and the third component each, and may be lower than the sintering temperature described above (or lower than the melting point of the magnet base material 2). The diffusion temperature may be adjusted depending on the composition, the melting point or the decomposition temperature of the first component, the second component and the third component each. For example, in the case of the first embodiment, where both of the first component and the second component are metals, the diffusion temperature may be 800° C. or more and 950° C. or less. In the case of the second embodiment, where both of the first component and the second component are hydrides, the diffusion temperature may be 800° C. or more and 950° C. or less. In the diffusion step, the temperature of the magnet base material 2 may be gradually raised from a temperature lower than the diffusion temperature to the diffusion temperature. For example, in a lower temperature region of about 600° C., Nd as a liquid phase (Nd-rich phase) easily seeps from the main phase grains 4 of the magnet base material 2 to the grain boundaries. In a temperature region of about 800° C., melting of the hydride of Dy easily proceeds. The time for maintaining the temperature of the magnet base material 2 at the diffusion temperature (diffusion time) may be, for example, 1 hour or more and 50 hours or less. The atmosphere of the magnet base material 2 in the diffusion step may be a non-oxidizing atmosphere. The non-oxidizing atmosphere may be, for example, a rare gas such as argon.

The total mass of Tb, Dy, Nd, Pr and Cu in the diffusing material may be expressed as $M_{ELEMENTS}$. The total mass of Tb and Dy in the diffusing material relative to $M_{ELEMENTS}$ may be 47% by mass or more and 86% by mass or less, 55% by mass or more and 85% by mass or less, 55% by mass or more and 80% by mass or less, or 59% by mass or more and 75% by mass or less. The total mass of Tb and Dy may be paraphrased as the total mass of RH in the diffusing material. In the case where the total mass of RH is 55% by mass or more, the total amount of the diffusing material required for increasing the coercivity of a permanent magnet is easily reduced. In the case where the total mass of RH is 85% by mass or less, reduction in the residual magnetic flux density of a permanent magnet is easily suppressed, and the manufacturing cost of a permanent magnet is reduced.

The total mass of Nd and Pr in the diffusing material relative to $M_{ELEMENTS}$ may be 10% by mass or more and 43% by mass or less, 10% by mass or more and 37% by mass or less, 15% by mass or more and 37% by mass or less, or 15% by mass or more and 32% by mass or less. The total mass of Nd and Pr may be paraphrased as the total mass of RL in the diffusing material. In the case where the total mass of RL is 10% by mass or more, an ample liquid phase of RL is easily present in the grain boundaries in the diffusion step, so that the diffusion of RH into the two-grain boundaries 10 through the liquid phase of RL is easily facilitated. In the case where the total mass of RL is 37% by mass or less, the first component (RH) is not excessively diluted with the second component (RL), so that the coercivity of a permanent magnet is easily increased.

The Cu content in the diffusing material relative to $M_{ELEMENTS}$ may be 4% by mass or more and 30% by mass or less, 8% by mass or more and 25% by mass or less, or 8% by mass or more and 20% by mass or less. In the case where the Cu content is 4% by mass or more, RH diffuses easily into the two-grain boundaries 10 and the vicinity of the surface of the main phase grains 4, and the diffusion of RH into the internal part of the main phase grains 4 is easily suppressed. In the case where the Cu content is 30% by mass or less, reduction in the coercivity and the residual magnetic flux density of a permanent magnet is easily suppressed. In the case where the magnet base material 2 comprises Cu, Cu derived from the magnet base material 2 may exhibit the same effect as Cu derived from the diffusing material. However, it is difficult to obtain the same effect as Cu derived from the diffusing material by Cu derived from the magnet base material 2 only.

The particle size of each of the first component, the second component and the third component may be in a range of 0.3 μm or more and 32 μm or less, or 0.3 μm or more and 90 μm or less. The particle size of each of the first component, the second component and the third component may be paraphrased as the particle size of the diffusing material. As the particle size of the diffusing material increases, oxygen contained in the diffusing material decreases, so that the diffusion of RH, RL and Cu is hardly blocked by oxygen. As a result, the coercivity of a permanent magnet is easily increased. As the particle size of the diffusing material decreases, the time required for melting the first component, the second component and the third component each is shortened, so that RH, RL and Cu each easily diffuse into the internal part of the magnet base material 2. As a result, the coercivity of a permanent magnet is easily increased. Also, as the particle size of the diffusing material decreases, the diffusing material adheres easily to the surface of the magnet base material 2 evenly, so that RH, RL and Cu each diffuse easily into the internal part of the magnet base material 2 evenly. As a result, the variation of the coercivity of a permanent magnet is suppressed and the squareness ratio easily approaches 1.0. The particle size of each of the first component, the second component and the third component may be the same. The particle size of each of the first component, the second component and the third component may be different from each other.

The mass of the magnet base material 2 may be expressed as 100 parts by mass, and the total mass of Tb and Dy in the diffusing material may be 0.0 part by mass or more and 2.0 parts by mass or less relative to 100 parts by mass of the magnet base material 2. In the case where the total mass of Tb and Dy relative to the magnet base material 2 is in the range described above, the total content of Tb and Dy in the whole of the permanent magnet is easily controlled to 0.20% by mass or more and 2.00% by mass or less, so that the magnetic properties of the permanent magnet are easily improved.

The total content of Nd and Pr in the magnet base material 2 may be 23.0% by mass or more and 32.0% by mass or less. The total content of Tb and Dy in the magnet base material 2 may be 0.0% by mass or more and 5.0% by mass or less. The total content of Fe and Co in the magnet base material 2 may be 63% by mass or more and 72% by mass or less. The Cu content in the magnet base material 2 may be 0.04% by mass or more and 0.5% by mass or less. In the case where the magnet base material 2 has the composition described above, the magnetic properties of the permanent magnet are easily increased.

[Heat Treatment Step]

After being subjected to the diffusion step, the magnet base material 2 may be used as a finished product of a permanent magnet. Alternatively, after the diffusion step, a heat treatment step may be performed. In the heat treatment step, the magnet base material 2 may be heated at 450° C. or more and 600° C. or less. In the heat treatment step, the magnet base material 2 may be heated at the temperature for 1 hour or more and 10 hours or less. By the heat treatment step, the magnetic properties (in particular, coercivity) of a permanent magnet are easily improved.

The dimensions and the shape of the magnet base material 2 subjected to the diffusion step or the heat treatment step may be adjusted by processing such as cutting and polishing.

The permanent magnet is completed by the method described above. The permanent magnet is a neodymium magnet comprising at least R, T, B and Cu. The permanent magnet comprises Nd and at least one of Tb and Dy as R. In other words, the permanent magnet comprises Nd and RH as R. The permanent magnet may further comprise Pr in addition to Nd and RH as R. The permanent magnet may further comprise other rare-earth elements other than Nd, Pr, Tb and Dy. The permanent magnet may comprise some of or all of elements contained in the raw material alloy described above.

The composition of each of the magnet base material and permanent magnet may be identified by an analytical method such as energy dispersive X-ray spectrometry (EDS), X-ray fluorescence spectroscopy (XRF), inductivity coupled plasma emission spectrometry (ICP), inert gas fusion-nondispersive infrared absorption spectrometry, combustion in oxygen stream-infrared absorption spectrometry, and inert gas fusion-thermal conductivity method.

The dimensions and the shape of a permanent magnet are various depending on the use of the permanent magnet without specific limitations. The shape of the permanent magnet may be, for example, rectangular parallelpiped, cubic, rectangular (tabular), polygonal column, arc segmented, fan-shaped, annular sectorial, spherical, disk-shaped, cylindrical, ring-shaped or capsule. The shape of the cross-section of the permanent magnet may be, for example, polygonal, arc-like (circular chord-like), bow-shaped, arch-shaped, or circular. The dimensions and the shape of the magnet base material 2 may be various in the same manner as those of the permanent magnet.

The permanent magnet may be used in various fields such as hybrid vehicles, electric vehicles, hard disk drives, magnetic resonance imaging apparatuses (MRI), smart phones, digital cameras, flat-panel TV sets, scanners, air conditioners, heat pumps, refrigerators, vacuum cleaners, washing and drying machines, elevators and wind power generators. The permanent magnet may be used as a material to compose a motor, a generator and an actuator.

The present invention is not limited to the embodiments described above. For example, the magnet base material for use in the diffusion step may be a hot-deformed magnet. A hot-deformed magnet may be manufactured by the following manufacturing method.

The raw material of a hot-deformed magnet may be an alloy which is the same as the alloy for use in making a sintered body. The alloy is melted and quenched to obtain a ribbon of alloy. The ribbon is pulverized to obtain a raw material powder in a flake form. The raw material powder is cold pressed (forming at room temperature) to obtain a green compact. After preheating of the green compact, the green compact is hot pressed to obtain an isotropic magnet. The isotropic magnet is subjected to hot plastic working to obtain an anisotropic magnet. The anisotropic magnet is subjected to an aging treatment to obtain a magnet base material made of hot-deformed magnet. The magnet base material made of hot-deformed magnet includes many main phase grains bounded to each other in the same manner as the sintered body described above.

EXAMPLES

Although the present invention will be described still more specifically with reference to Examples and Comparative Examples in the following, the present invention is not limited to the following Examples.

<Manufacturing of Magnet Base Material A>

A raw material alloy 1 was made from raw material metals by strip casting. The composition of the raw material alloy 1 was adjusted by weighing raw material metals, such that the composition of the raw material alloy 1 after sintering coincided with the composition of a magnet base material A in the following Table 1.

After hydrogen was stored into the raw material alloy 1 at room temperature, the raw material alloy 1 was heated at 600° C. for 1 hour in an Ar atmosphere for dehydrogenation, so that a raw material alloy powder was obtained. In other words, hydrogen pulverization treatment was performed.

As pulverization aid, zinc stearate was added to the raw material alloy powder, and the they were mixed by a cone mixer. The content of zinc stearate in the raw material alloy powder was adjusted to 0.1% by mass. In the subsequent fine pulverization step, the average particle size of the raw material alloy powder was adjusted to 4.0 μm by using a jet mill. In the subsequent molding step, the raw material alloy powder was packed in a mold. While applying a magnetic field of 1200 kA/m to the raw material powder in the mold, the raw material powder was pressurized at 120 MPa to obtain a green compact.

In a sintering step, the green compact was heated at 1060° C. for 4 hours in vacuum and then quenched to obtain a sintered body.

As an aging step, a first aging and a second aging subsequent to the first aging were performed. In both of the first aging and the second aging, the sintered body was heated in an Ar atmosphere. In the first aging, the sintered body was heated at 850° C. for 1 hour. In the second aging, the sintered body was heated at 540° C. for 2 hours.

By the method described above, the magnet base material A was obtained. The content of each element in the magnet base material A is shown in the following Table 1.

<Manufacturing of Magnet Base Material B>

A raw material alloy 2 was made from raw material metals by strip casting. The composition of the raw material alloy 2 was adjusted by weighing raw material metals, such that the composition of the raw material alloy 2 after sintering coincided with the composition of a magnet base material B in the following table.

A magnet base material B was made from a raw material alloy 2. The method for manufacturing the magnet base material B was the same as the method for manufacturing the magnet base material A except for the composition of the raw material alloy. The content of each of the elements in the magnet base material B is shown in the following Table 1.

<Manufacturing of Magnet Base Material C>

A raw material alloy 3 was made from raw material metals by strip casting. The composition of the raw material alloy 3 was adjusted by weighing raw material metals, such that the composition of the raw material alloy 3 after sintering coincided with the composition of a magnet base material C in the following Table.

A magnet base material C was made from a raw material alloy 3. The method for manufacturing the magnet base material C was the same as the method for manufacturing the magnet base material A except for the composition of the raw material alloy. The content of each element in the magnet base material C is shown in the following Table 1.

<Manufacturing of Diffusing Material A>

As raw material of a diffusing material A, a simple substance of Tb (single metal substance) was used. The purity of the simple substance of Tb was 99.9% by mass.

After hydrogen was stored into the simple substance of Tb at room temperature, the simple substance of Tb was heated at 600° C. for 1 hour in an Ar atmosphere for dehydrogenation, so that a powder of hydride of Tb was obtained. In other words, hydrogen pulverization treatment was performed.

As pulverization aid, zinc stearate was added to the powder of hydride of Tb, and the they were mixed by a cone mixer. The content of zinc stearate in the powder of hydride of Tb was adjusted to 0.1% by mass. In the subsequent fine pulverization step, the powder of hydride of Tb was further pulverized under a non-oxidizing atmosphere with an oxygen content of 3000 ppm. The fine pulverization step was performed by using a jet mill. The average particle size of the powder consisting of hydride of Tb was adjusted to about 10.0 μm.

By the method described above, the powder (first component) consisting of hydride of Tb ($TbH_2$) was obtained. The powder consisting of hydride of Tb, an alcohol (solvent) and an acrylic resin (binder) were kneaded to manufacture a diffusing material A in a paste form. The mass ratio of the first component in the diffusing material A was 75.0 parts by mass. The mass ratio of the solvent in the diffusing material A was 23.0 parts by mass. The mass ratio of the binder in the diffusing material A was 2.0 parts by mass.

<Manufacturing of Diffusing Material B>

A powder (second component) consisting of hydride of Nd ($NdH_2$) was manufactured from a simple substance of Nd. The purity of the simple substance of Nd was 99.9% by mass. The average particle size of the powder consisting of hydride of Nd was about 10.0 μm. The method for manufacturing the powder of hydride of Nd was the same as the method for manufacturing the powder of hydride of Tb, except that the simple substance of Nd was used as raw material.

The powder consisting of hydride of Tb (first component), the powder consisting of hydride of Nd (second component), a powder consisting of simple substance of Cu (third component), an alcohol (solvent), and an acrylic resin (binder) were kneaded to manufacture a diffusing material B in a paste form. The mass ratio of the first component in the diffusing material B was 46.8 parts by mass. The mass ratio of the second component in the diffusing material B was 17.0 parts by mass. The mass ratio of the third component in the diffusing material B was 11.2 parts by mass. The mass ratio of the solvent in the diffusing material B was 23.0 parts by mass. The mass ratio of the binder in the diffusing material B was 2.0 parts by mass.

As described above, $M_{ELEMENTS}$ means the total mass of Tb, Nd and Cu in the diffusing material. $M_{ELEMENTS}$ is 100% by mass. The Tb content in the diffusing material means the mass ratio of Tb in the diffusing material relative to $M_{ELEMENTS}$ (unit: % by mass). The Nd content in the diffusing material means the mass ratio of Nd in the diffusing material relative to $M_{ELEMENTS}$ (unit: % by mass). The Cu content in the diffusing material means the mass ratio of Cu in the diffusing material relative to $M_{ELEMENTS}$ (unit: % by mass).

The Tb content in the diffusing material B was 62.5% by mass. The Nd content in the diffusing material B was 22.5% by mass. The Cu content in the diffusing material B was 15% by mass.

<Manufacturing of Sample 1>

By mechanical processing of the magnet base material A, the dimensions of the magnet base material A was adjusted to a length of 14 mm, a width of 10 mm, and a thickness of 4.2 mm. After adjustment of dimensions of the magnet base material A, the magnet base material A was subjected to an etching treatment. In the etching treatment, all surfaces of the magnet base material A was washed with an aqueous solution of nitric acid. Subsequently, all surfaces of the magnet base material A was washed with pure water. After washing, the magnet base material A was dried. The concentration of the aqueous solution of nitric acid was 0.3% by mass. After the etching treatment, the following diffusion step was performed.

In the diffusion step, the diffusing material B was applied to all surfaces of the magnet base material A. The mass of the diffusing material B applied to the magnet base material A was adjusted such that the mass of Tb contained in the diffusing material B became 0.5 parts by mass relative to 100 parts by mass of the magnet base material A. The magnet base material A coated with the diffusing material B was placed in an oven and heated at 160° C., so that the solvent in the diffusing material B was removed. After removal of the solvent, the magnet base material A coated with the diffusing material B was heated at 900° C. for 6 hours in Ar gas.

In a heat treatment step subsequent to the diffusion step, the magnet base material A was heated at 540° C. for 2 hours in Ar gas.

By the method described above, a permanent magnet of Sample 1 was manufactured. The content of each of the elements in the permanent magnet of Sample 1 is shown in the following Table 2.

In the diffusion step of each of Samples 2 to 14 described below also, the mass of the diffusing material applied to the magnet base material was adjusted such that the mass of Tb contained in the diffusing material became 0.5 parts by mass relative to 100 parts by mass of the magnet base material.

<Manufacturing of Sample 2>

In the diffusion step of Sample 2, the mixing ratio of the first component, the second component and the third component in the diffusing material B was changed. The Tb content in the diffusing material for use in manufacturing Sample 2 is shown in the following Table 1. The Nd content in the diffusing material for use in manufacturing Sample 2 is shown in the following Table 1. The Cu content in the diffusing material for use in manufacturing Sample 2 is shown in the following Table 1.

A permanent magnet of Sample 2 was manufactured by the same method as in Sample 1 except for the composition of the diffusing material. The content of each element in the permanent magnet of Sample 2 is shown in the following Table 2.

<Manufacturing of Sample 3>

The diffusing material for use in manufacturing in Sample 3 comprised the first component and the third component, not comprising the second component. The Tb content in the diffusing material for use in manufacturing Sample 3 is shown in the following Table 1. The Cu content in the diffusing material for use in manufacturing Sample 3 is shown in the following Table 1.

A permanent magnet of Sample 3 was manufactured in the same manner as in Sample 1 except for the composition of the diffusing material. The content of each of the elements in the permanent magnet of Sample 3 is shown in the following Table 2.

<Manufacturing of Sample 4>

In the diffusion step of Sample 4, the diffusing material B was applied to all surfaces of the magnet base material B. A permanent magnet of Sample 4 was manufactured in the same manner as in Sample 1 except for the composition of the magnet base material. The content of each of the elements in the permanent magnet of Sample 4 is shown in the following Table 2.

<Manufacturing of Sample 5>

In the diffusion step of Sample 5, the mixing ratio of the first component, the second component and the third component in the diffusing material B was changed. The Tb content in the diffusing material for use in manufacturing Sample 5 is shown in the following Table 1. The Nd content in the diffusing material for use in manufacturing Sample 5 is shown in the following Table 1. The Cu content in the diffusing material for use in manufacturing Sample 5 is shown in the following Table 1.

The permanent magnet of Sample 5 was manufactured by the same method as in Sample 4 except for the composition of the diffusing material. The content of each element in the permanent magnet of Sample 5 is shown in the following Table 2.

<Manufacturing of Sample 6>

In the diffusion step of Sample 6, the mixing ratio of the first component, the second component and the third component in the diffusing material B was changed. The Tb content in the diffusing material for use in manufacturing Sample 6 is shown in the following Table 1. The Nd content in the diffusing material for use in manufacturing Sample 6 is shown in the following Table 1. The Cu content in the diffusing material for use in manufacturing Sample 6 is shown in the following Table 1.

The permanent magnet of Sample 6 was manufactured by the same method as in Sample 4 except for the composition of the diffusing material. The content of each element in the permanent magnet of Sample 6 is shown in the following Table 2.

<Manufacturing of Sample 7>

In the diffusion step of Sample 7, the mixing ratio of the first component, the second component and the third component in the diffusing material B was changed. The Tb content in the diffusing material for use in manufacturing Sample 7 is shown in the following Table 1. The Nd content in the diffusing material for use in manufacturing Sample 7 is shown in the following Table 1. The Cu content in the diffusing material for use in manufacturing Sample 7 is shown in the following Table 1.

The permanent magnet of Sample 7 was manufactured by the same method as in Sample 4 except for the composition of the diffusing material. The content of each element in the permanent magnet of Sample 7 is shown in the following Table 2.

<Manufacturing of Sample 8>

In the diffusion step of Sample 8, the diffusing material A was applied to all surfaces of the magnet base material B. A permanent magnet of Sample 8 was manufactured by the same method as in Sample 4 except for the composition of the diffusing material. The content of each element in the permanent magnet of Sample 8 is shown in the following Table 2.

<Manufacturing of Sample 9>

The diffusing material for use in manufacturing Sample 9 comprised the first component and the second component, not comprising the third component. The Tb content in the diffusing material for use in manufacturing Sample 9 is shown in the following Table 1. The Nd content in the diffusing material for use in manufacturing Sample 9 is shown in the following Table 1.

A permanent magnet of Sample 9 was manufactured by the same method as in Sample 4 except for the composition of the diffusing material. The content of each element in the permanent magnet of Sample 9 is shown in the following Table 2.

<Manufacturing of Sample 10>

In the diffusion step of Sample 10, the particle size of the first component, the second component and the third component was adjusted in the range shown in the following Table 4. The median diameter (D50) of the first component, the second component and the third component was 6.1 μm. The diffusing material for use in the diffusion step for Sample 10 was the same as the diffusing material B except for the particle size of the first component, the second component and the third component.

In the diffusion step of Sample 10, the diffusing material described above was applied to all surfaces of the magnet base material C.

The permanent magnet of Sample 10 was manufactured by the same method as in Sample 1 except for the diffusing material and the magnet base material. The content of each element in the permanent magnet of Sample 10 is shown in the following Table 2.

<Manufacturing of Sample 11>

In the diffusion step of Sample 11, the diffusing material A was applied to all surfaces of the magnet base material C.

The permanent magnet of Sample 11 was manufactured by the same method as in Sample 10 except for the diffusing material. The content of each element in the permanent magnet of Sample 11 is shown in the following Table 2.

<Manufacturing of Sample 12>

In the diffusion step of Sample 12, the particle size of the first component, the second component and the third component was adjusted in the range shown in Table 4. The diffusing material for use in the diffusion step for Sample 12 was the same as the diffusing material B except for the particle size of the first component, the second component and the third component.

The permanent magnet of Sample 12 was manufactured by the same method as in Sample 10 except for the particle size of the first component, the second component and the third component. The content of each element in the permanent magnet of Sample 12 is shown in the following Table 5.

<Manufacturing of Sample 13>

In the diffusion step of Sample 13, the particle size of the first component, the second component and the third component was adjusted in the range shown in the following Table 4. The diffusing material for use in the diffusion step for Sample 13 was the same as the diffusing material B except for the particle size of the first component, the second component and the third component.

The permanent magnet of Sample 13 was manufactured by the same method as in Sample 10 except for the particle size of the first component, the second component and the third component. The content of each element in the permanent magnet of Sample 13 is shown in the following Table 5.

<Manufacturing of Sample 14>

In the diffusion step of Sample 14, the particle size of the first component, the second component and the third component was adjusted in the range shown in Table 4. The median diameter (D50) of the first component, the second component and the third component was 1.4 μm. The diffusing material for use in the diffusion step for Sample 14 was the same as the diffusing material B except for the particle size of the first component, the second component and the third component.

The permanent magnet of Sample 14 was manufactured by the same method as in Sample 10 except for the particle size of the first component, the second component and the third component. The content of each element in the permanent magnet of Sample 14 is shown in the following Table 5.

[Evaluation of Magnetic Properties]

By cutting the surface of each permanent magnet, a portion having a depth of 0.1 mm or less from the surface was removed. Subsequently, the residual magnetic flux density Br and the coercivity HcJ of each permanent magnet were measured by a BH tracer. Br (unit: mT) was measured at room temperature. HcJ (unit: kA/m) was measured at 160° C.

A permanent magnet is used in a motor or a generator installed on an electric vehicle or a hybrid vehicle. With the operation of the motor or the generator, the temperature of the permanent magnet increases. As the temperature of the permanent magnet increases, the coercivity of the permanent magnet decreases. Due to restriction of design and manufacturing cost of a vehicle, a cooling device for the permanent magnet is not necessarily installed on the vehicle. The permanent magnet is therefore required for having a sufficient coercivity even at high temperature. The coercivity at 160° C. is an index for evaluating magnetic properties of the permanent magnet at high temperature.

Based on the measurement values of Br and HcJ each, the squareness ratio Hk/HcJ of each of the permanent magnets was calculated.

PI (potential index) of each permanent magnet defined by the following numerical expression was calculated. Br in the following numerical expression is a measurement value of residual magnetic flux density at room temperature. HcJ in the following numerical expression is a measurement value of coercivity at 160° C. The residual magnetic flux density and the coercivity are in a trade-off relation. In other words, as the residual magnetic flux density increases, the coercivity tends to decrease, and as the coercivity increases, the residual magnetic flux density tends to decrease. PI calculated from Br and HcJ is an index for evaluating the residual magnetic flux density and the coercivity in a comprehensive way. It is preferable that PI be large.

$$PI = Br + 25 \times HcJ \times 4\pi / 2000$$

Br, HcJ, Hk/HcJ and PI of Samples 1 to 11 each are shown in the following Table 3. Br, HcJ, Hk/HcJ and PI of Samples 12 to 14 each are shown in the following Table 5.

TABLE 1

| | | Magnet base material | Content of each element (% by mass) | | | | | | | | | | | | |
|---|---|---|---|---|---|---|---|---|---|---|---|---|---|---|---|
| | | | Magnet base material | | | | | | | | | | Diffusing material | | |
| | | | Nd | Pr | Dy | Co | Cu | Zr | Al | Ga | B | Fe | Tb | Nd | Cu |
| Sample 1 | Example | Magnet base material A | 23.0 | 7.0 | 0.0 | 2.00 | 0.20 | 0.20 | 0.20 | 0.20 | 0.90 | bal. | 62.5 | 22.5 | 15 |
| Sample 2 | Example | Magnet base material A | 23.0 | 7.0 | 0.0 | 2.00 | 0.20 | 0.20 | 0.20 | 0.20 | 0.90 | bal. | 59 | 37 | 4 |
| Sample 3 | Comparative Example | Magnet base material A | 23.0 | 7.0 | 0.0 | 2.00 | 0.20 | 0.20 | 0.20 | 0.20 | 0.90 | bal. | 86 | 0 | 14 |
| Sample 4 | Example | Magnet base material B | 28.0 | 0.5 | 1.5 | 0.50 | 0.07 | 0.20 | 0.20 | 0.10 | 0.95 | bal. | 62.5 | 22.5 | 15 |
| Sample 5 | Example | Magnet base material B | 28.0 | 0.5 | 1.5 | 0.50 | 0.07 | 0.20 | 0.20 | 0.10 | 0.95 | bal. | 60 | 10 | 30 |
| Sample 6 | Example | Magnet base material B | 28.0 | 0.5 | 1.5 | 0.50 | 0.07 | 0.20 | 0.20 | 0.10 | 0.95 | bal. | 47 | 43 | 10 |
| Sample 7 | Example | Magnet base material B | 28.0 | 0.5 | 1.5 | 0.50 | 0.07 | 0.20 | 0.20 | 0.10 | 0.95 | bal. | 85 | 10 | 5 |
| Sample 8 | Comparative Example | Magnet base material B | 28.0 | 0.5 | 1.5 | 0.50 | 0.07 | 0.20 | 0.20 | 0.10 | 0.95 | bal. | 100 | 0 | 0 |
| Sample 9 | Comparative Example | Magnet base material B | 28.0 | 0.5 | 1.5 | 0.50 | 0.07 | 0.20 | 0.20 | 0.10 | 0.95 | bal. | 75 | 25 | 0 |
| Sample 10 | Example | Magnet base material C | 20.0 | 6.0 | 4.0 | 0.50 | 0.07 | 0.20 | 0.20 | 0.15 | 0.95 | bal. | 62.5 | 22.5 | 15 |
| Sample 11 | Comparative Example | Magnet base material C | 20.0 | 6.0 | 4.0 | 0.50 | 0.07 | 0.20 | 0.20 | 0.15 | 0.95 | bal. | 100 | 0 | 0 |

TABLE 2

| | | Content of each element in permanent magnet (% by mass) | | | | | | | | | | | | | |
|---|---|---|---|---|---|---|---|---|---|---|---|---|---|---|---|
| | | Nd | Pr | Dy | Tb | Fe | Co | Cu | Zr | Al | Ga | O | C | N | B |
| Sample 1 | Example | 23.0 | 7.0 | 0.0 | 0.35 | bal. | 2.00 | 0.30 | 0.20 | 0.20 | 0.20 | 0.10 | 0.10 | 0.05 | 0.90 |
| Sample 2 | Example | 23.0 | 7.0 | 0.0 | 0.31 | bal. | 2.00 | 0.28 | 0.20 | 0.20 | 0.20 | 0.10 | 0.10 | 0.05 | 0.90 |
| Sample 3 | Comparative Example | 23.0 | 7.0 | 0.0 | 0.29 | bal. | 2.00 | 0.23 | 0.20 | 0.20 | 0.20 | 0.10 | 0.10 | 0.05 | 0.90 |
| Sample 4 | Example | 28.0 | 0.5 | 1.5 | 0.30 | bal. | 0.50 | 0.20 | 0.20 | 0.20 | 0.10 | 0.10 | 0.10 | 0.05 | 0.95 |
| Sample 5 | Example | 28.0 | 0.5 | 1.5 | 0.33 | bal. | 0.50 | 0.31 | 0.20 | 0.20 | 0.10 | 0.10 | 0.10 | 0.05 | 0.95 |
| Sample 6 | Example | 28.0 | 0.5 | 1.5 | 0.25 | bal. | 0.50 | 0.14 | 0.20 | 0.20 | 0.10 | 0.10 | 0.10 | 0.05 | 0.95 |
| Sample 7 | Example | 28.0 | 0.5 | 1.5 | 0.20 | bal. | 0.50 | 0.10 | 0.20 | 0.20 | 0.10 | 0.10 | 0.10 | 0.05 | 0.95 |
| Sample 8 | Comparative Example | 28.0 | 0.5 | 1.5 | 0.17 | bal. | 0.50 | 0.07 | 0.20 | 0.20 | 0.10 | 0.10 | 0.10 | 0.05 | 0.95 |
| Sample 9 | Comparative Example | 28.0 | 0.5 | 1.5 | 0.18 | bal. | 0.50 | 0.07 | 0.20 | 0.20 | 0.10 | 0.10 | 0.10 | 0.05 | 0.95 |
| Sample 10 | Example | 20.0 | 6.0 | 4.0 | 0.35 | bal. | 0.50 | 0.20 | 0.20 | 0.20 | 0.15 | 0.10 | 0.10 | 0.05 | 0.95 |
| Sample 11 | Comparative Example | 20.0 | 6.0 | 4.0 | 0.18 | bal. | 0.50 | 0.07 | 0.20 | 0.20 | 0.15 | 0.10 | 0.10 | 0.05 | 0.95 |

TABLE 3

| | | Magnet base material | Content of each element in diffusing material (% by mass) | | | Br | HcJ | Hk/HcJ | |
|---|---|---|---|---|---|---|---|---|---|
| | | | Tb | Nd | Cu | (mT) | (kA/m) | (%) | PI |
| Sample 1 | Example | Magnet base material A | 62.5 | 22.5 | 15 | 1458 | 680 | 98.2 | 1565 |
| Sample 2 | Example | Magnet base material A | 59 | 37 | 4 | 1455 | 652 | 96.3 | 1557 |
| Sample 3 | Comparative Example | Magnet base material A | 86 | 0 | 14 | 1455 | 635 | 94.8 | 1555 |
| Sample 4 | Example | Magnet base material B | 62.5 | 22.5 | 15 | 1389 | 744 | 97.1 | 1506 |
| Sample 5 | Example | Magnet base material B | 60 | 10 | 30 | 1386 | 738 | 96.9 | 1502 |
| Sample 6 | Example | Magnet base material B | 47 | 43 | 10 | 1379 | 712 | 96.4 | 1491 |

TABLE 3-continued

| | | Magnet base material | Content of each element in diffusing material (% by mass) Tb | Nd | Cu | Br (mT) | HcJ (kA/m) | Hk/HcJ (%) | PI |
|---|---|---|---|---|---|---|---|---|---|
| Sample 7 | Example | Magnet base material B | 85 | 10 | 5 | 1388 | 673 | 95.4 | 1494 |
| Sample 8 | Comparative Example | Magnet base material B | 100 | 0 | 0 | 1389 | 637 | 94.1 | 1489 |
| Sample 9 | Comparative Example | Magnet base material B | 75 | 25 | 0 | 1385 | 645 | 94.7 | 1486 |
| Sample 10 | Example | Magnet base material C | 62.5 | 22.5 | 15 | 1355 | 1000 | 97.5 | 1512 |
| Sample 11 | Comparative Example | Magnet base material C | 100 | 0 | 0 | 1357 | 832 | 94.2 | 1488 |

TABLE 4

| | | Content of each element (% by mass) Magnet base material C Nd | Pr | Dy | Co | Cu | Zr | Al | Ga | B | Fe | Diffusing material Tb | Nd | Cu | Particle size of diffusing material (μm) |
|---|---|---|---|---|---|---|---|---|---|---|---|---|---|---|---|
| Sample 10 | Example | 20.0 | 6.0 | 4.0 | 0.50 | 0.07 | 0.20 | 0.20 | 0.15 | 0.95 | bal. | 62.5 | 22.5 | 15 | 0.3-32 |
| Sample 12 | Example | 20.0 | 6.0 | 4.0 | 0.50 | 0.07 | 0.20 | 0.20 | 0.15 | 0.95 | bal. | 62.5 | 22.5 | 15 | 0.3-90 |
| Sample 13 | Example | 20.0 | 6.0 | 4.0 | 0.50 | 0.07 | 0.20 | 0.20 | 0.15 | 0.95 | bal. | 62.5 | 22.5 | 15 | 150-500 |
| Sample 14 | Example | 20.0 | 6.0 | 4.0 | 0.50 | 0.07 | 0.20 | 0.20 | 0.15 | 0.95 | bal. | 62.5 | 22.5 | 15 | 0.2-6.5 |

TABLE 5

| | Content of each element in permanent magnet (% by mass) Nd | Pr | Dy | Tb | Fe | Co | Cu | Zr | Al | Ga | O | C | N | B | Br (mT) | HcJ (kA/m) | Hk/HcJ (%) | PI |
|---|---|---|---|---|---|---|---|---|---|---|---|---|---|---|---|---|---|---|
| Sample 10 | 20.0 | 6.0 | 4.0 | 0.35 | bal. | 0.50 | 0.20 | 0.20 | 0.20 | 0.15 | 0.10 | 0.10 | 0.05 | 0.95 | 1355 | 1000 | 97.5 | 1512 |
| Sample 12 | 20.0 | 6.0 | 4.0 | 0.33 | bal. | 0.50 | 0.19 | 0.20 | 0.20 | 0.15 | 0.10 | 0.10 | 0.05 | 0.95 | 1354 | 988 | 96.9 | 1509 |
| Sample 13 | 20.0 | 6.0 | 4.0 | 0.25 | bal. | 0.50 | 0.12 | 0.20 | 0.20 | 0.15 | 0.09 | 0.09 | 0.05 | 0.95 | 1355 | 895 | 94.6 | 1496 |
| Sample 14 | 20.0 | 6.0 | 4.0 | 0.28 | bal. | 0.50 | 0.16 | 0.20 | 0.20 | 0.15 | 0.13 | 0.12 | 0.04 | 0.95 | 1352 | 948 | 94.4 | 1501 |

As shown in Table 3, Samples 1 to 3 having a common composition of the magnet base material were compared. Br of each of Samples 1 and 2 was approximately equal to Br of Sample 3. HcJ of each of Samples 1 and 2 was larger than HcJ of Sample 3. Hk/HcJ of each of Samples 1 and 2 was larger than Hk/HcJ of Sample 3. PI of each of Samples 1 and 2 was larger than PI of Sample 3.

As shown in Table 3, Samples 4 to 9 having a common composition of the magnet base material were compared. Br of each of Samples 4 to 7 was approximately equal to Br of Samples 8 and 9. HcJ of each of Samples 4 to 7 was larger than HcJ of Samples 8 and 9. Hk/HcJ of each of Samples 4 to 7 was larger than Hk/HcJ of Samples 8 and 9. PI of each of Samples 4 to 7 was larger than PI of Samples 8 and 9.

As shown in Table 3, Samples 10 and 11 having a common composition of the magnet base material were compared. Br of Sample 10 was approximately equal to Br of Sample 11. HcJ of Sample 10 was larger than HcJ of Sample 11. Hk/HcJ of Sample 10 was larger than Hk/HcJ of Sample 11. PI of Sample 10 was larger than PI of Sample 11.

INDUSTRIAL APPLICABILITY

According to the method for manufacturing an R-T-B permanent magnet of the present invention, an R-T-B permanent magnet suitable as the material of a motor installed on hybrid vehicles or electric vehicles is obtained.

REFERENCE SIGN LIST

2: MAGNET BASE MATERIAL, 2*cs*: CROSS SECTION OF MAGNET BASE MATERIAL, 4: MAIN PHASE GRAIN, 6: GRAIN BOUNDARY TRIPLE POINT, 10: TWO-GRAIN BOUNDARY

What is claimed is:

1. A method for manufacturing an R-T-B permanent magnet, comprising a diffusion step of adhering a diffusing material to a surface of a magnet base material and heating the magnet base material with the diffusing material adhered thereto, wherein the magnet base material comprises rare-earth elements R, transition metal elements T, and boron B;

at least some of the rare-earth elements R are neodymium;

at least some of the transition metal elements T are iron;

the diffusing material consists of i) a first component, a second component, and a third component, ii) the first component, the second component, the third component, and a solvent, or iii) the first component, the second component, the third component, the solvent, and a binder;

the first component consists of at least one of a hydride of terbium and a hydride of dysprosium;

the second component consists of at least one of a hydride of neodymium and a hydride of praseodymium; and the third component consists of at least one selected from the group consisting of a simple substance of copper, a hydride of copper, and an oxide of copper, wherein the total mass of terbium, dysprosium, neodymium, praseodymium, and copper in the diffusing material is expressed as $M_{ELEMENTS}$;

the total mass of terbium and dysprosium in the diffusing material relative to $M_{ELEMENTS}$ is 55% by mass or more and 85% by mass or less;

the total mass of neodymium and praseodymium in the diffusing material relative to $M_{ELEMENTS}$ is 10% by mass or more and 37% by mass or less; and the total mass of copper in the diffusing material relative to $M_{ELEMENTS}$ is 4% by mass or more and 30% by mass or less.

2. The method for manufacturing an R-T-B permanent magnet according to claim 1, wherein the diffusing material is a slurry or a paste.

3. A method for manufacturing an R-T-B permanent magnet, comprising a diffusion step of adhering a diffusing material to a surface of a magnet base material and heating the magnet base material with the diffusing material adhered thereto, wherein the magnet base material comprises rare-earth elements R, transition metal elements T, and boron B;

at least some of the rare-earth elements R are neodymium;

at least some of the transition metal elements T are iron;

the diffusing material comprises a first component, a second component, and a third component;

the first component is at least one of a hydride of terbium and a hydride of dysprosium;

the second component is at least one of a hydride of neodymium and a hydride of praseodymium;

the third component is at least one selected from the group consisting of a simple substance of copper, an alloy comprising copper, and a compound of copper, the total mass of terbium, dysprosium, neodymium, praseodymium, and copper in the diffusing material is expressed as $M_{ELEMENTS}$;

the total mass of terbium and dysprosium in the diffusing material relative to $M_{ELEMENTS}$ is 55% by mass or more and 85% by mass or less;

the total mass of neodymium and praseodymium in the diffusing material relative to $M_{ELEMENTS}$ is 10% by mass or more and 37% by mass or less; and the total mass of copper in the diffusing material relative to $M_{ELEMENTS}$ is 4% by mass or more and 30% by mass or less.

4. The method for manufacturing an R-T-B permanent magnet according to claim 3, wherein the diffusing material is a slurry or a paste.

* * * * *